United States Patent [19]

Schoeffler, William N. et al.

[11] Patent Number: 4,732,223

[45] Date of Patent: Mar. 22, 1988

[54] CONTROLLABLE DOWNHOLE DIRECTIONAL DRILLING TOOL

[75] Inventors: Schoeffler, William N., Lafayette; Jerry J. Dugas, Breaux Bridge, both of La.

[73] Assignee: Universal Downhole Controls, Ltd., Breaux Bridge, La.

[21] Appl. No.: 798,694

[22] PCT Filed: Jun. 12, 1985

[86] PCT No.: PCT/US85/01116

§ 371 Date: Oct. 28, 1985

§ 102(e) Date: Oct. 28, 1985

[87] PCT Pub. No.: WO86/00111

PCT Pub. Date: Jan. 2, 1986

Related U.S. Application Data

[63] Continuation-in-part of Ser. No. 619,866, Jun. 12, 1984, Pat. No. 4,597,454.

[51] Int. Cl.[4] ..... E21B 7/04

[52] U.S. Cl. ..... 175/73; 175/61; 175/256

[58] Field of Search ..... 175/60, 61, 73, 256

[56] References Cited

U.S. PATENT DOCUMENTS

| | | | |
|---|---|---|---|
| 4,303,135 | 12/1981 | Benoit | 175/73 |
| 4,522,272 | 6/1985 | Beimgraben | 175/74 |
| 4,597,454 | 7/1986 | Schoeffler | 175/73 |

FOREIGN PATENT DOCUMENTS

| | | | |
|---|---|---|---|
| 205740 | 7/1968 | U.S.S.R. | 175/61 |

*Primary Examiner*—Stephen J. Novosad
*Assistant Examiner*—William P. Neuder
*Attorney, Agent, or Firm*—Pravel Gambrell Hewitt Kimball & Krieger

[57] ABSTRACT

A directional drilling tool permits the control of the angle of drilling of a drill bit through the repeated placement or removal of a ball within the mudstream. The ball activates a clutch mechanism within the directional drilling tool. The clutch mechanism, upon activiation, locks the exterior of the directional drilling sub to a fixed angular orientation. Simultaneously, there is activated a deflection mechanism to deflect a drive shaft which is normally fixed in an aligned straight position within the tube body, so as to shift the normally straight aligned shaft to a deflected position, causing the bit and the sub to angle for drilling at a controlled angle of offset from the vertical. The unit is aligned and located using wireline measuring equipment of known design. Since the sub may be controllably set in a straight line drilling or an angle drilling position, it may be left permanently in position in a drill string significantly reducing the requirement to trip out of the well bore during directional drilling and significantly increase the flexibility available to the driller to deflect the direction of drilling while drilling is in progress. There is further provided a mechanism for assisting in returning the tool to the straight aligned position for resumption of straight drilling. A second embodiment utilizes a deflection cam engaging the drive shaft directly to effect the deflection of the shaft.

6 Claims, 14 Drawing Figures

126
124
122
120
106
104
102
99
98
90
94
96
86
91
8
88
121
92
84

CONTROLLABLE DOWNHOLE DIRECTIONAL DRILLING TOOL

This is a continuation-in-part of application Ser. No. 619,866, filed June 12, 1984, now U.S. Pat. No. 4,597,454.

BACKGROUND OF THE INVENTION

Both the cost of maintaining a drilling rig for such purposes as drilling oil wells and the complexity of underground formations encountered in deephole drilling, have led to the need for the ability to drill multiple, angled or deflected drill holes from a single drilling platform.

This process of directional drilling has involved improvements and innovations both in the construction of the actual drilling subs and drill bits for use at the bottom end or drilling end of a drill string as well as significant improvements in the instrumentation necessary to control and monitor the downhole progress of the drilling.

For the purposes of this patent application, it is necessary only to point out that within the art of oil well drilling, wireline tools have been devised which are lowered through the inner tubular region of a drill string to a point adjacent the actual drilling bit, and permit monitors on the surface or floor of the drill rig to determine the angle, depth, and general environmental conditions being encountered by the drill bit. In particular, it is possible, using current wireline technology to establish orientation within a downhole drilling sub and to determine positively the existing downhole rotational orientation and angle of drilling orientation at any point within the drilling process.

Drilling subs or directional drilling currently known to the art are of two major constructions. The first are designed principally for use when the rotation energy imparted to a drill is imparted by rotating the entire drill string from rotation imparted by a rotating table installed on a drill rig floor; or angled subs; that is, the drilling sub is constructed at a permanent offset so that rotation entered at the top of the sub is angled and proceeds to rotate the drill bit at an offset angle at the bottom of the sub, without drill string rotation. These units are in essence very large analogs to an angled drive collet known in the drilling art and machine shops and the like. In order to engage in drilling using such a sub, the entire drill string must be tripped out, the appropriate angled sub installed, the drill string re-entered into the bore and drilling using the angled sub commenced. The total amount of deflection is the function of the distance drilled while the angled sub is installed. When the desired deflection has been achieved, the entire drill string must again be tripped out, the angled sub removed, and straight subs re-installed so as to permit continued straight line drilling at the new, deflected direction.

In the field of downhole drill motors, such as the turbine drilling devices, driven by mudflow and the like, it is possible to create an angled deflection by controlling the flow of the mud preferentially out one portion of the drill bit. Such apparatuses are known and are widely used.

The primary cost and difficulty encountered in current art directional drilling devices is the general necessity that for each change of direction at least two trips of the drill string are required to install and remove the directional drilling apparatus. Such drill string activity is nonproductive, considerably slows the drilling process, and introduces other problems such as drill string sticking, possible hole collapse and the like, all of which are well known to the art. It is therefore considered highly desirable that the number of trips of the drill string during the drilling operation be minimized, and that the amount of time actually spent drilling be maximized. This is especially true on an offshore platform where all the wells drilled are usually drilled from an initial starting bore and where the success of the offshore drilling platform is totally dependent upon the ability to engage a multiple directional drilling.

SUMMARY OF THE INVENTION

What is provided is a directional drilling tool adapted for installation immediately above the drill bit. Within the tool housing is contained a rotating driving or torquing tool running substantially the length of the interior of the housing. This shaft conducts the rotating torque of the drill string from the tools connecting socket with drill string to the actual drill bit, and during straight aligned drilling, the entire tool rotates in unison with the drill string. Also, contained within the tool is a mechanism for bending or deflecting the interior torquing tool to drill in a directional mode, the mechanism being driven by switchable mud pressure from the drill mud flow. The mechanism, when activated, would engage a cam block housing which upon downward shifting of the driving shaft would force the cam block housing which houses the straight aligned torquing tube tool to a position off center within the tool housing and deflect the drive tube to the side of the interior of the sub, and thereby deflect the drill bit connected to the lower end of the drive shaft through a rotating drive joint. This deflection in turn causes the entire tool to drill at an angle, creating the desired deflected drilling.

A drive clutch mechanism, of a particular design to permit control and repeatability of the orientation of the outer housing wall of the tool, is also activated by a mud-driven valving mechanism so as to, in the first position, permit rotation of the outer housing of the tool so as to rotatably align the deflection mechanism to a given direction, and when activated to a second position, decouple the housing wall of the tool together with the deflection mechanism from rotation so as to maintain a given offset angle of drilling. There is also provided means intermediate the deflection housing at the lower end of the outer tool housing for assisting in returning the tool to the straight aligned position. Inasmuch as the tool is capable of drilling both at a deflected angle and as a straight aligned drilling tool, there is no necessity of removing the tool from the bottom of the drill string. The tool thereby is capable of being used for substantially the entire period of time the drilling operations are engaged in and need be removed only as would be required for removing the drill bit.

Likewise, the tool is particularly adapted to monitoring with wire line so as to establish a given rotational position. The sub thus controls the direction of drilling by controlling a rotational azimuth, allowing the azimuth to be establilshed by an activation of the coupling clutch before described and also by establishing an offset angle in a second plane about the axis of rotation or offset from the axis of rotation of the tool.

The controlling clutch mechanism which activates the tool is driven by the pressure of mudflow from the continous flow of drilling mud and fluid within a drill string. The mudflow is diverted to activate the controlling clutch by a ball controlled valve mechanism which is activated to a angled drilling position by dropping a ball in the mudflow through the center of the drill string. This ball is readily removed using standard downhole ball activated technology. The design of the activating valve is such that positive activation of the clutch produces a sensible change in the pressure and flow rate of the drilling mud and thus positive activation of the directional drilling device may be readily ascertained by the drilling operator.

It is thus an object of this invention to provide an improved downhole drilling tool capable of controllably drilling a straight or a deflected hole.

It is a further object of the present invention to provide a directional drilling tool which is able to operate during rotation of the drill string.

It is a further object of the present invention to provide a directional drilling tool having an inner deflectable shaft situated in an outer housing.

It is a further object of this invention to provide a directional drilling tool which may be alternately set between straight aligned drilling and directional drilling without removal of the tool from the borehole.

It is a further object of this invention to provide a downhole drilling tool which gives a positive indication at the drilling floor of its actuation to a deflected or a straight ahead drilling sequence.

It is a further object of this invention to provide a downhole directional drilling tool which includes a means which prevents the deflectable shaft from deflecting while the tool is drilling in straight alignment.

These and other objects of this invention will be readily apparent to those skilled in the art from the detailed description and claims which follow.

DETAILED DESCRIPTION OF THE PREFERRED EMBODIMENT

Figure 1:
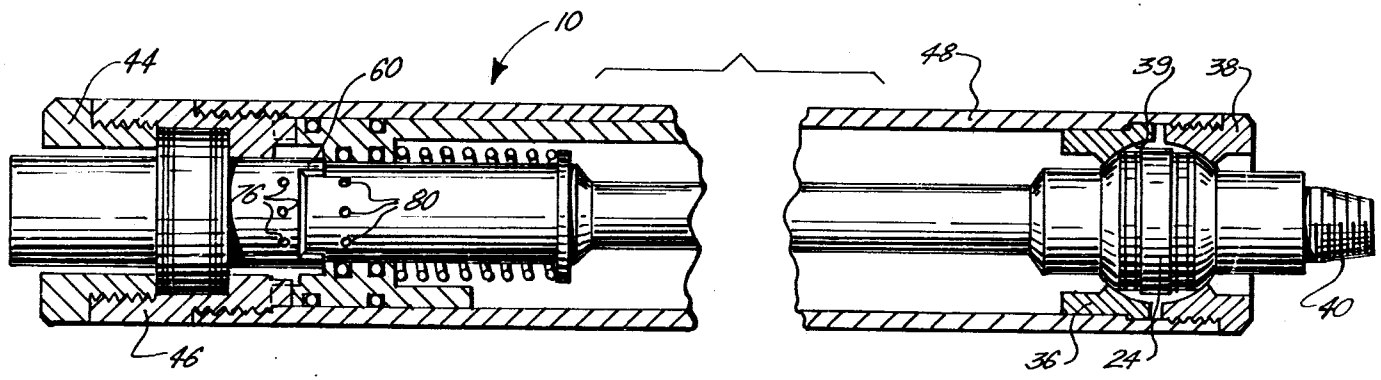
FIG. 1 is a partial view of the preferred embodiment of the clutch apparatus of the present invention.
Figure 4:
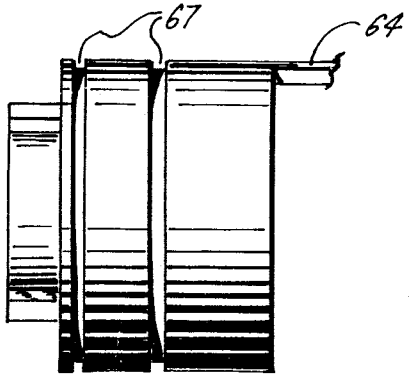
FIG. 4 is a side view of the clutch mechanism of the apparatus of the present invention.

Referring principally to FIG. 1 the directional drilling tool 10 of the present invention is shown as connected to a driving drill string 12 extending downward as a standard drill string well known to the art. The driving drill string 12 is connected to the directional sub 10 by means of an API pin and socket joint 14, constructed as a tapered screw and socket joint by the Amercian Petroleum Institute's standard for joints and drill strings.

Rotatably connected through API pin and socket joint 14 to driving drill string 12 is drive tube assembly 16. Drive tube assembly 16 is an essentially hollow, cylindrical tube assembly extending, rotatably connectably between the API pin and socket joint 14 to lower internal rotating spline joint 18.

Internal spline joint 18 is a joint splinably connecting drive tube assemly 16 to cylindrical deflection drive tube 20 for accomodating flexing of tube 20. An essentially hollow tubular passage 22 adapted to drilling mud flow extends vertically down the center axis of drive tube assembly 16 and deflection drive tube 20. Mud flow passage 22 is flowably connected to an identical mud flow passage found within string 12 and in turn connects flowingly for mud to drill bit 30 as will be described.

At a bottom end of deflection drive tube 20 is found angularly displaceable lower thrust bearing assembly 24. Angularly displaceable thrust bearing 24 is comprised in the preferred embodiment of the invention of a first thrust bearing 26 and a second thrust bearing 28 circumferentially placed on rotating compliant bearing ball 32. First thrust bearing 26 and second thrust bearing 28 are installed parallel to each other equi-distantly spaced from and centering between themselves rotating compliant ball pivot point 33. First thrust bearing 26 and second thrust bearing 28 further support rotating compliant bearing ball 32 against bearing socket 34.

Bearing socket 34 comprises an upper curved bearing support collar 36 and a split, lower curved bearing support collar 38. Each of bearing support collar 36 and bearing support collar 38 have an internally curved arcuate face 39. Arcuate face 39 on each of upper curved collar 36 and lower bearing collar 38 are inverted to one another to form thereby a continuous essentially circular arch surface supporting rotatably first thrust bearing 26 and second thrust bearing 28 for sliding. Curved arcuate face 39 is thereby essentially circumferentially positioned about pivot point 33.

At a lower end of deflective drive tube 20 is found a standard drive joint 40 of the style of joint well known in the art for connecting to a drill bit 30. Drill bit 30 is of any standard design for drilling an oil well or the like and, as is known, is provided with a receiving mud flow passage for receiving mud from mud flow passage 22.

The essentially columnar rotating assembly comprising drive tube assembly 16 and deflection drive tube 20 defines a vertical axis of rotation and is cylindrically inserted within an outer subcasing assembly 42. Outer subcasing 42 in turn comprises an upper collar piece 44 defining an upper end to casing assembly 42. Cylindrically extending downward from and fixedly attached to upper curved collar 44 is outer casing clutch cylinder 46. Clutch cylinder 46 presents on its exterior a continuing cylindrical surface adapted to fitting within a drill hole bore in the manner of a standard drilling sub and on its interior provides a clutch member for coupling outer casing assembly 42 to drive tube assembly 16 in a manner to be described.

Fixedly connected to clutch cylinder 46 and extending cylindrically down therefrom at a uniform diameter to clutch cylinder 46 is outer casing cylinder 48. Outer casing cylinder 48 defines essentially the majority of the length and outer periphery of the overall directional sub 10, and defines the orientable, outer casing member aligned in the bore.

Figure 3:
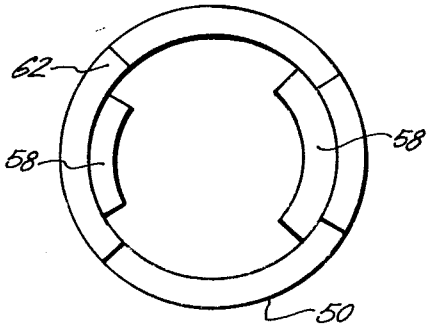
FIG. 3 is a top view of the clutch mechanism of the apparatus of the present invention.
Figure 6:
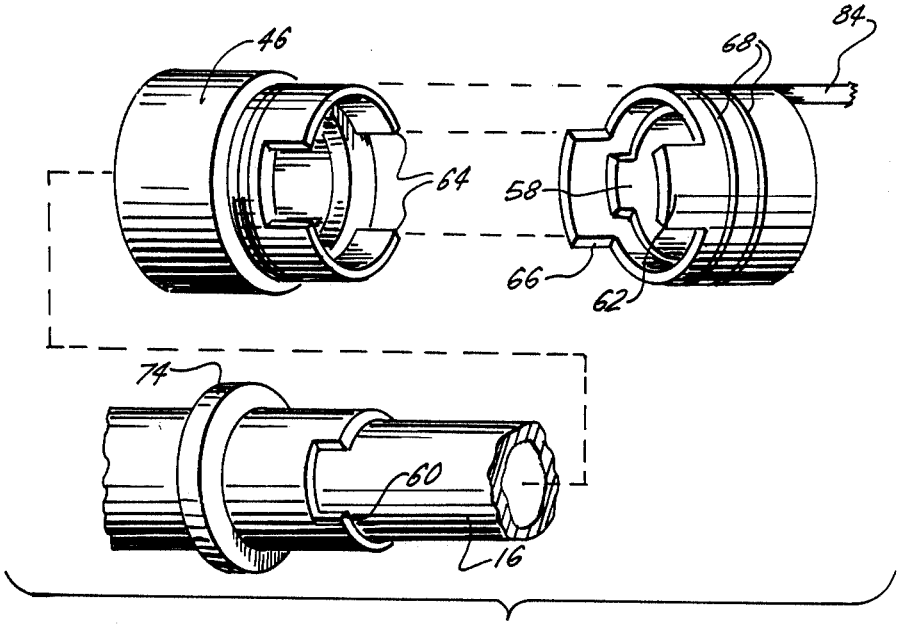
FIG. 6 is an exploded view of the clutch mechanism of the apparatus of the preferred embodiment of the apparatus of the present invention.

At a lower end of outer casing cylinder 48 are found, fixedly attached by screw threads in the preferred embodiment, upper curved bearing 36 which is circumferentially inserted within an interior of outer casing cylinder 48 and lower bearing collar 38 which is also fixedly disposed extending upward within cylinder 48 fixedly connected thereto, spacedly supported from upper curved collar 44 so as to maintain the previously before described proper curvature to curved arcuate face 39. Outer casing cylinder 48 is essentially hollow for its internal length containing therein deflection tube clutch and deflection assembly 50. Deflection tube clutch and deflection assembly 50 comprises a second spring-loaded cylindrical self-aligning spline clutch member 52. Spline clutch member 52 is spring-loaded by spring 54 against spring retaining collar 56 upon a lower outer periphery drive tube assembly 16. Spring retaining collar 56 reacts so as to provide a substantially upward bias on spline clutch member 52. Spline clutch member 52 in turn engages with first nondisengaging internal spline coupling 58 (FIGS. 3 and 6) to a provided circumferential face driving spline 60 (FIGS. 1 and 6) circumferentially disposed around drive tube assembly 16.

Clutch member 52 also disposes second outer self-aligning spline clutch member 62 (FIG. 6) engaging to mating self-aligning drive spline 64 disposed about the lower face of outer casing upper clutch cylinder 46. Angularly disposed, circumferentially about two points upon clutch member 52 are first and second ring seal means 66 sealingly disposed against the inner wall of outer casing cylinder 48.

Interiorly disposed angularly within spline clutch member 52 are first and second inner ring seal means 68 sealingly disposed against the outer cylindrical surface of drive tube assembly 16.

Figure 5:
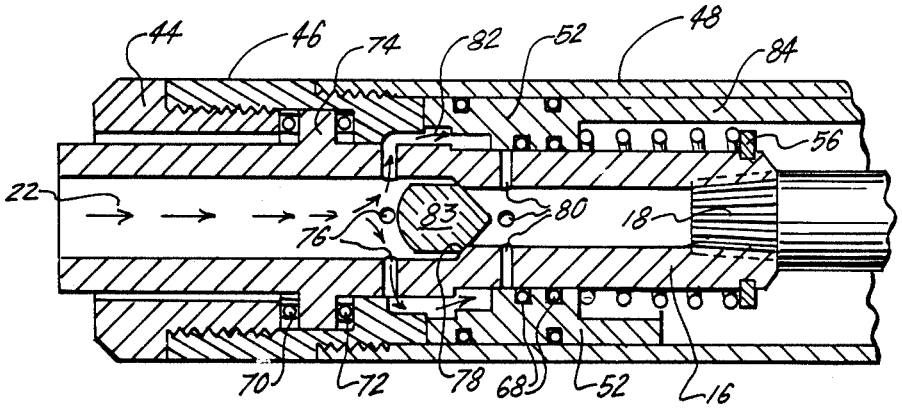
FIG. 5 is a side cutaway view of the clutch mechanism and drive tube assembly of the preferred embodiment of the apparatus of the present invention.

Drive tube assembly 16 is supported for rotation above clutch member 52 by rotating bearing assembly 70 (FIG. 5). In the preferred embodiment of the invention bearing support member 70 comprises two parallel thrust bearings circumferentially installed upon drive tube 16, bearing for thrust upwardly against upper collars 44 and downwardly for thrust against thrust shoulder 72 of outer case clutch cylinder 46. Drive tube assembly clutch collar 74 supports said first and second bearing assemblies forming thereby rotating bearing support member 70.

As stated, mud flow passage 22 extends axially within drive tube assembly 16. At a first upper point on drive tube assembly 16, immediately above circumferential faced driving spline 60 are found a plurality of mud flow passages 76. Within mud flow passage 22, immediately below first mud flow passages 76, the diameter of mud flow passage 22 is necked in by flow shoulder 78 providing thereby an effective restriction to the passage of objects occupying the full diameter of mud flow passage 22. Immediately below flow shoulder 78 are found second mud flow passages 80. A plurality of mud flow passages, essentially equal in number and area to that of upper mud flow passages 76 are provided communicating between mud flow passage 22 and the exterior of drive tube assembly 16.

A mud pressure activation chamber 82 is formed within an angular area defined by outer casing cylinder 48, the lower end of outer clutch cylinder 46, the upper end of spline clutch member 52 and the outer surface of drive tube assembly 16, in an angular region connectingly adjacent to circumferential face driving spline 60.

Driveably extending downward from spline clutch member 52 interiorly and fixedly extending within the angular region between the interior of outer casing cylinder 48 and deflection drive tube 20 is deflection driving shaft 84, which operates in conjunction with the operation of deflection mechanism 86 (FIG. 7) and deflection tube alignment means 88, as will be described.

What has been described heretofore structurally is the upper portion of the tool is operating through the clutch mechanism to facilitate the shifting of the tool from a straight aligned drilling tool to a directional drilling tool. Prior to a description in operation of the lower portion of the tube which includes the mechanism for deflecting the inner drive tube and the means for preventing the drive tube from deflecting when the tool is in the straight aligned drilling position, a discussion shall be had of the operation of the upper portion of the tool as was the structure which was described earlier. In operation the directional drilling sub 10 is installed, as is well understood in the art, through API pin and socket joint 14 to an existing drill string for drilling immediately above the drill bit 30. The drill bit 30 is installed by connection to drill bit drive joint 40 to a lower end of directional sub 10.

Figure 2:
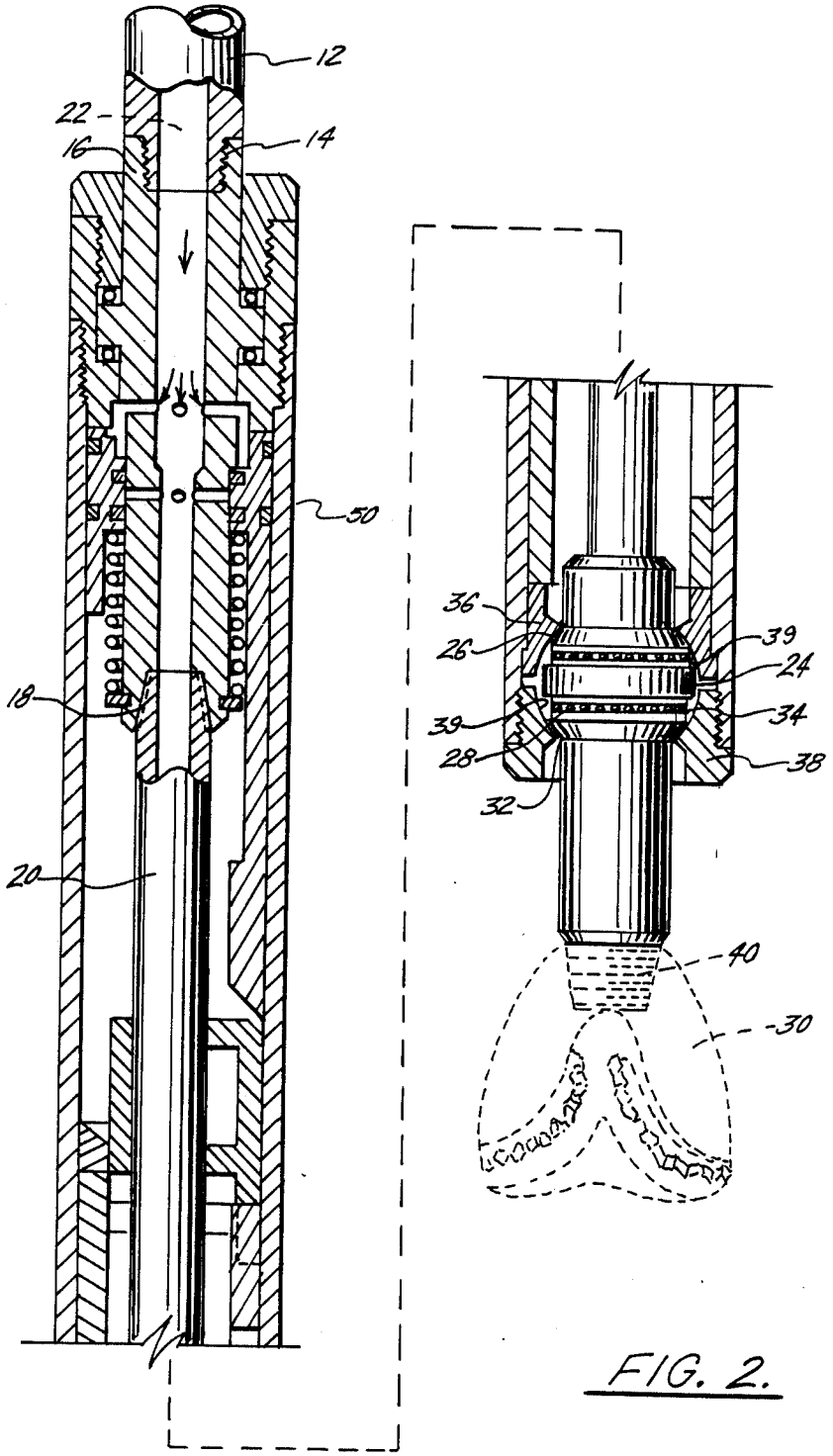
FIGS. 2 and 2-A are overall cutaway views of the preferred embodiment of the apparatus of the present invention.
Figure 2A:
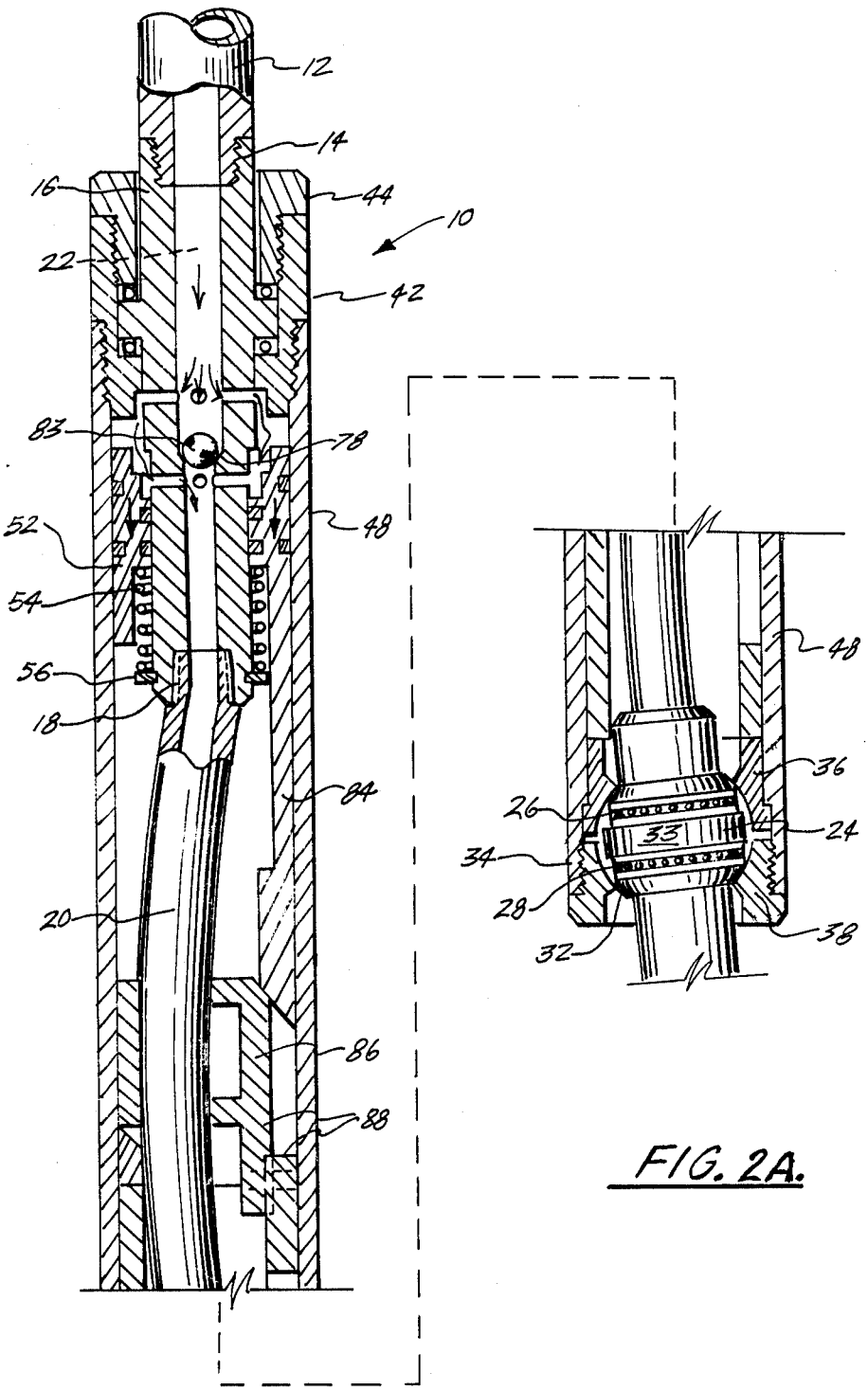

Drill bit 30 is activated for drilling by the rotation of overall driving string 12. The rotation of driving string 12 rotatably connected to pin and socket joint 14 rotates drive tube assembly 16. Drive tube assembly 16 through internal spline joint 18 rotates deflection drive tube 20, which is in its normal position a substantially straight tube member held in position by an internal alignment means, and constructed of tempered heat-treated steel or the like. Deflection drive tube 20 rotates through drive joint 40 (FIG. 2) drill bit 30 thus acting to drill an oil well bore hole.

The force of spring 54 against retaining collar 56 and spline clutch member 52 causes spline clutch member 52 to clutchedly align by engagement of splines through first internal spline coupling means 58 to the circumferential face driving spline 60 on drive tube assembly 16. Thus drive tube assembly 16 rotates spline clutch member 52. In turn spline clutch member 52 through self-aligning spline clutch 62 and 64 rotates outer casing clutch cylinder 46. Outer clutch casing cylinder 46, being fixedly connected to upper collar piece 44 and outer casing cylinder 48 rotate both outer casing cylinder 48 and upper collar piece 44. In this manner the entire directional sub 10, together with the drill string, rotates during straight drilling within the bore hole.

When it is desired for directional drilling to commence, a control ball or activating ball member 83 is inserted within the mud flow within the driving string 12. Driving ball 83 passes through the driving string 12 mud flow passage and into mud flow passage 22 of drive tube 16, but is of a chosen diameter such that it cannot pass flow shoulder 78. Ball 83 engages flow shoulder 78 blocking substantially mud passage 22 for the flow of mud through drive tube assembly 16. The mud pump pressure thus forces substantially the entire flow of drilling mud through passages 76 into mud piston activation chamber 82, applying thereby a substantial down hydraulic pressure against the upper shoulder of spline clutch member 52. Inasmuch as spline clutch member 52 is the only member free to move against the restraining force of spring 54, it is deflected downward compressing spring 54 and disengaging thereby first spline coupling means 58 from face driving spline 60 and second spline clutch 62 from spline clutch mating 64. This downward motion of clutch member 52 proceeds until lower mud flow passages 80 are open for flow, causing mud flow to re-enter mud passage 22 and continue down to drill bit 30. The hydraulic pressure of the mud flow through the restricted passages 80, maintains clutch member 52 in a down position. The reduced area of mud flow passages 76 and mud flow passages 80, however, causes a significant, sensible increase in the overall pressure and resistance to mud flow and a decrease in the quantity of mud pumped at a given pump pressure thus providing a positive indication to a drilling controller upon the drill rig floor of the activation of clutch 52.

Figures 7, 8:
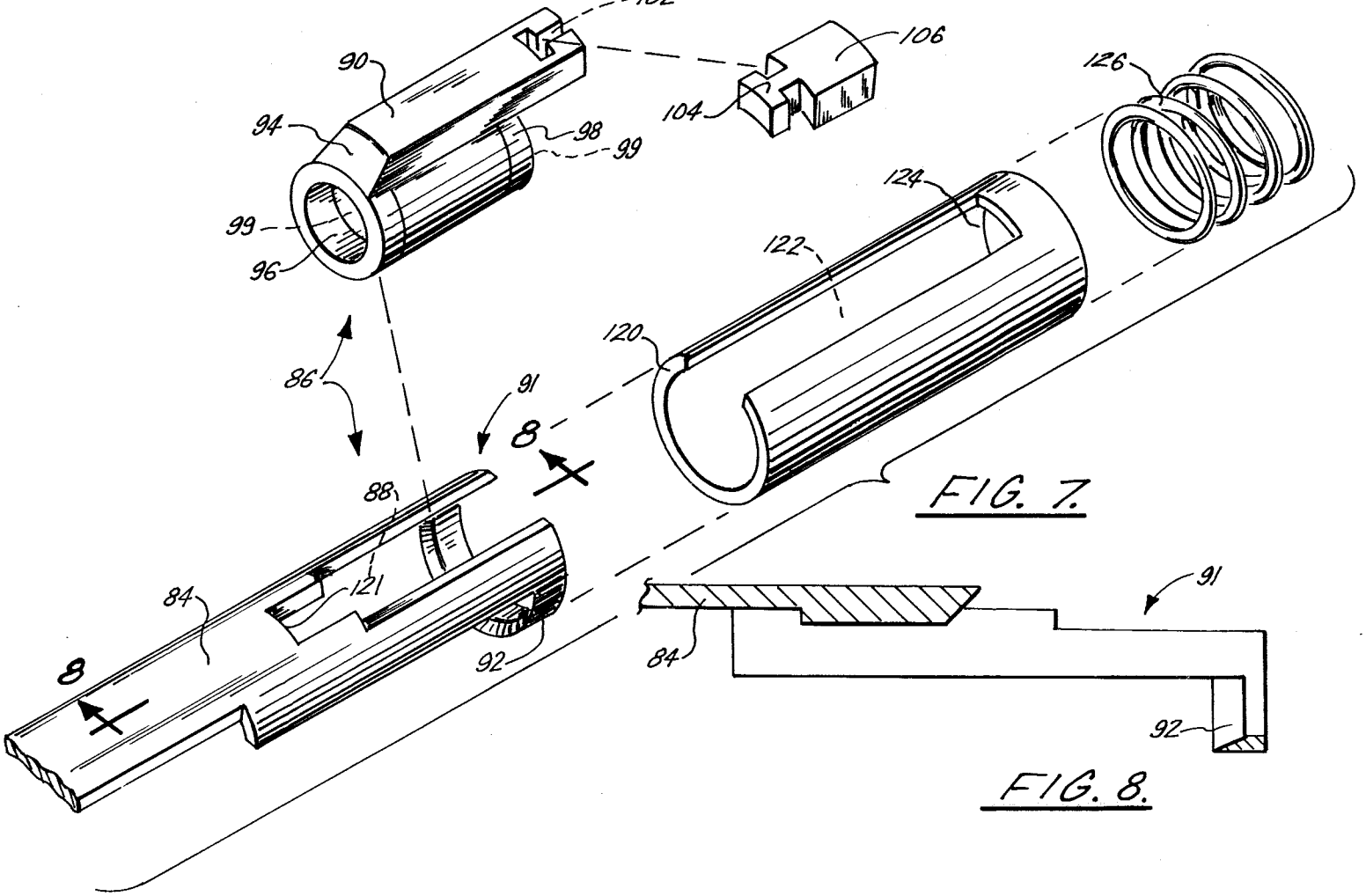
FIG. 7 is an exploded view of the alignment means and deflecting mechanism of the preferred embodiment of the apparatus of the present invention.
FIG. 8 is a side view taken along lines 8—8 of FIG. 7 of the cam block member and the preferred embodiment of the apparatus of the present invention.

Following the activation of clutch member 52 and the downward shifting of spline clutch member 52 against the bias of spline 54, there is seen in the FIGURES driving shaft 84 which is an elongated member extending downward along the inner wall of tool body 48 and moves downward in response to the downward movement of spline clutch member 52. As seen in FIG. 7, driving shaft 84 serves as a component of the overall deflecting mechanism 86 and alignment means 91 in shifting the drive tube between the first aligned position to a second deflected position within tool body 48. Structurally, as seen in the drawings, substantally at its mid length, driving tube 20 is housed within a pair of collar housings 96 and 98, which have a common bore 99 therethrough for slidingly housing driving tube 20. It should be recalled that in the deflected position, driving tube 20 rotates with the rotation of the drill string, and therefore bore 99 must be of a diameter to allow free rotation of tube 20 therewithin. As seen in the FIGURES, collars 96 and 98 are fixedly engaged to a cam block member 90 which is substantially a rectangular block having a first beveled face 94 which engages the face 95 of driving shaft 84, as will be described further. The second end portion of cam block member 90 extending past collar housing 98 has a keyseat 102 thereinto, and as seen in the FIGURES there is a key block 106 affixedly secured to the wall of tool housing 38 through bolting or the like, the keyblock 106 having a key member 104 which seats within keyseat 102 for preventing cam block member 90 from any upward or downward movement. Thus, as seen in the FIGURES, in the straight aligned position, key block member 90 is fixedly engaged in position along the wall of tool 38.

Figure 9:
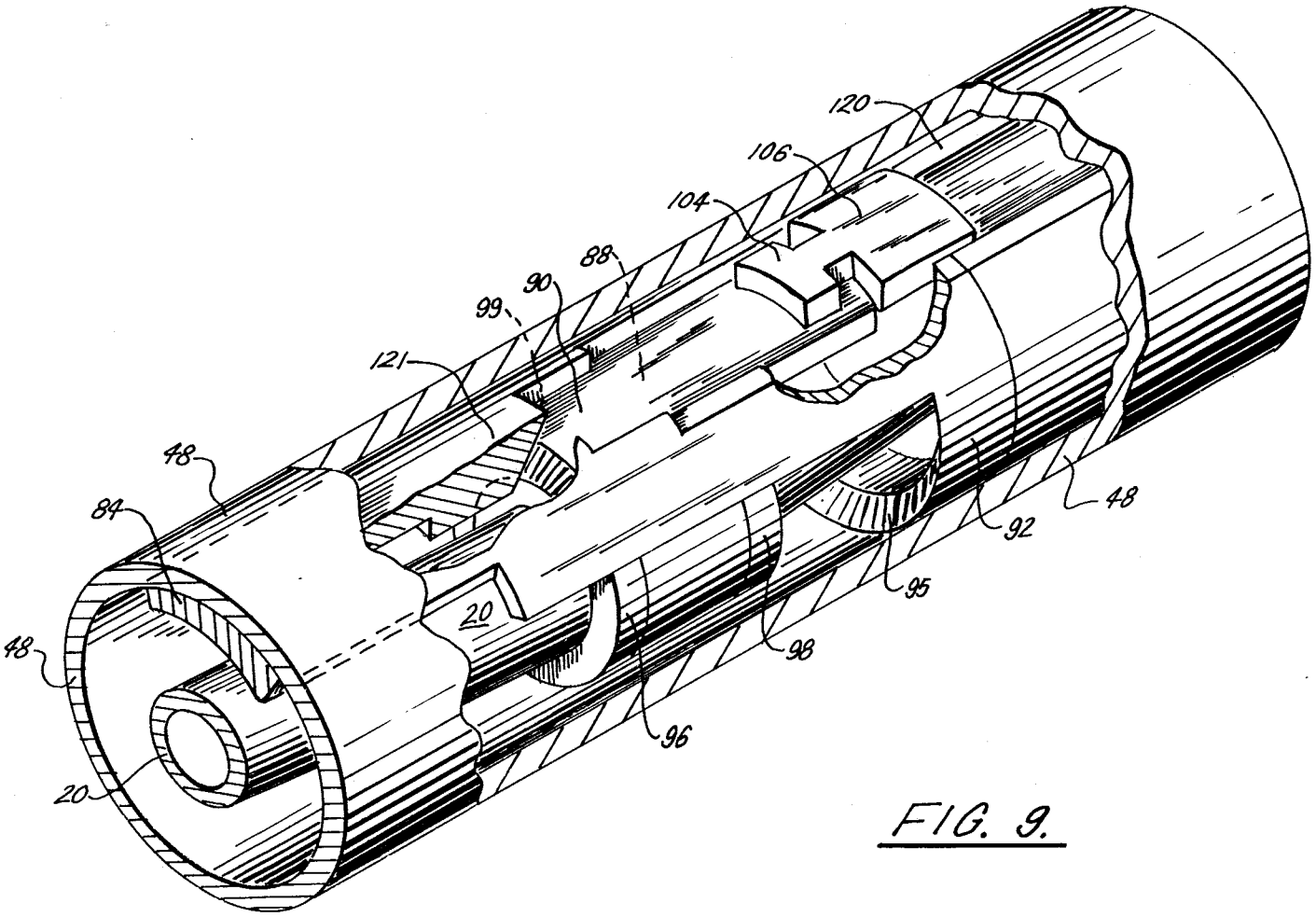
FIG. 9 is an overall cutaway view of the alignment means and deflection mechanism of the preferred embodiment of the apparatus of the present invention.
Figures 10, 11:
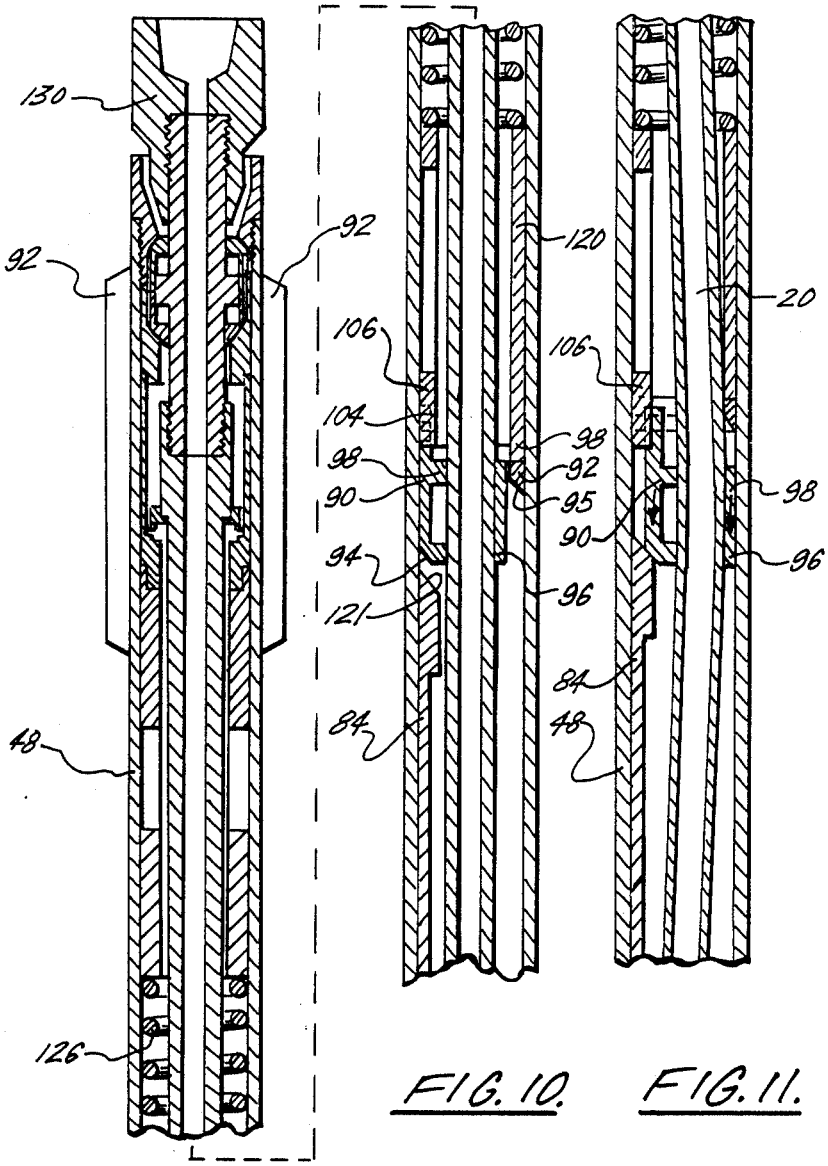
FIG. 10 is an overall side cutaway view of the alignment means and means for assisting in the repositioning of the driving arm in the preferred embodiment of the apparatus of the present invention.
FIG. 11 is an overall cutaway side view of the deflecting means of the preferred embodiment of the apparatus of the present invention.

It is imperative during the straight aligned drilling position, that should the drill bit encounter any hard substance or the like, the flexible internal tube 20 not deflect. In order to prevent this, there is included a means on the end portion of the drive shaft 84 for working in conjunction with the cam block and ring members 96 and 98 to prevent any lateral movement of the cam block during straight drilling. This alignment means would comprise generally a rectangular cutaway section 88 which would slidably house cam block member 90 during the upward and downward movement of driving shaft 84 during operation. Also, it would further comprise a second collar housing member 92 (FIG. 9) on the end portion of driving shaft 84 the inner diameter of which would be of substantially the same width as the outer diameter of ring housing 98 and in the straight aligned position ring housing 98 would be seated within collar housing 92, to form a continuous means between the inner driving tube 90 and the wall of tool housing 48 to prevent any deflecting movement of tube 20. Therefore, as seen in the drawings, in the straight position tube housing 20 is unable to deflect since there is no space between the wall of housing 20 and the inner wall of tool housing 48.

Therefore following the operation of the upper portion of the tool, the spline clutch member 52 moves down and then imparts downward movement to drive shaft 84. As was stated earlier, at this point, the cam block member in conjunction with collar housing 96 and 98 is positioned flat against the wall of tool housing 38, and collar 98 is seated within drive shaft ring 92 and no deflection can occur. Upon the downward traveling of arm 84, the beveled face 121 of driving shaft 84 engages the beveled face 94 of cam block 90, and shifts cam block. Since driving shaft 84 has moved a requisite amount to move ring 92 in misalignment with collar 98, cam block member 90 and collars 96 and 98 are free to shift laterally as driving shaft 84 moves cam block 90 away from wall thus to deflect tube 20 which is housed within collars 96 and 98, as seen in the FIGURES. As was stated earlier, since cam block member 90 cannot move up due to key block 106, the keyseat however allows the key lateral movement of cam block member 90 during the deflecting operation. Of course, cam block member 90 will move only so far laterally as the space between collar housings 98 and 96 and the opposite inner wall of tool body 38, and defines an inner, bendable torque passing member. In the preferred embodiment, the deflection angle approaches ⅔ to 1 degree of angular deflection.

It should be noted that delfection drive tube 20 is a substantially deflectable tube supported only at its ends. Also, on its upper end, deflection drive tube 20 is in splining engagement with the lower end of drive tube assembly 16, at the spline joint 18, so that upon reaching the deflection mode and returning to the straight mode as seen in the FIGURES, the spline joint 18 can accomodate the contraction and expansion of the distance occupied by flexible drive tube 20 during operation of the tool. Turning now to the lower portion of the tool as seen in the FIGURES, angularly displaceable lower thrust bearing assembly 24, which comprises primarily rotating compliant ball 32 and first and second thrust bearing 26 and 28, is free to rotate to a degree within the bearing socket 34 performed by upper curved collar 36 and lower curved collar 38. Compliant ball 32 rotating in response to the deflection of tube 20 changes the angle of drill bit 30 with respect to the center axis of outer casing cylinder 48 by a deflection amount established by the downward travel of cam driving member 86 upon the activation of spline clutch member 52 by mud pressure. This activation provides a known fixed and constant offset angular deflection for drill bit 30.

It will be recalled that the activation of clutch member 52 disengaged spline coupling means 62. This disengagement, as can been seen, decoupled the means by which outer casing cylinder 48 was rotated by the rotation of driving string 12. Driving casing cylinder 48 is maintained in a nonrotation mode by friction to the bore wall, augmented by optional stabilizer members 92 disposed above the outer surface of cylinder 48. However, and this is crucial in this invention, the remainder of the drill string above casing cylinder 46 is constantly rotating, which while accomplishing directional drilling, is able to maintain free rotation within the hole to avoid sticking as is a constant problem with directional drilling. Thus, with respect to a given drill hole or bore during the straightline drilling permits the rotation of casing cylinder 48 and thereby the azimuthial rotation of cam driving member 84 and cam block 90. By means of known wireline technology, such as Sperry Sun, the exact azimuthical position of sub 10 can be determined. Thus by manipulation of the rotation of driving string 12, the azimuth or compass angle of deflection to be produced by drive sub 10 can be established. As described above, upon activation of the deflection by activation of the clutch member 52, outer casing member 48 is substantially engaged in the bore hole against rotation but preserving this azimuth orientation. Thus there is provided a fixed angular offset at a controllable azimuth, providing thereby a controlled offset drill.

Drilling is continued in the controlled offset mode until the desired second direction of drilling is established. At which point, a wireline ball removal tool, well known in the art, is lowered to remove the activating ball from against flow shoulder 78. The removal of activating ball 83 restores mud flow through passage 22 the spring action of spring 54 helps return spline clutch member 52 to an engaged position.

Of course, upon clutch member 52 turning to the engaged position, drive arm 84 moves upward, and therefore this upward shifting, as seen in the Figures, allows cam block 90 to return to its position in alignment against the wall of tube body 48, thus realigning drive tube 20 in the straight position. The upward movement of arm 84 also would reposition collar housing 92 to the position seated in and in alignment with ring 98 and therefore resume its function to serve as a means for maintaining flexible tube 20 in the straight aligned position.

An additional feature of the tool 10 includes means for assisting in the returning of spline clutch member 52 to the engaged position. This would normally be accomplished through the expansion of spring 54 which would restore upward movement to arm 84. However, as a safety feature, there is further provided a cylindrical housing 120 (FIG. 7) which rests against the face of collar housing 92 and contains a rectangular cutaway section 122 in alignment with cutaway section 88 of driving member 86 to accomodiate key block 106 and cam block 90 during operation of the tool. On the opposite end portion 124 of housing 120 there is a spring 126 which extends from end portion 124 and rests against a second sleeve member 128, the second end of which abuts against the shoulder of support collar 36 adjacent the thrust bearing assembly 24. Therefore, drive shaft 84 moves downward and imparts downward movement to housing 120 against the bias of spring 126 and sleeve 128. Therefore, following the ability of spline member 52 to return to the engaged position, the upward movement of arm 84 is assisted as spring 126 expands to its normal position and imparts upward force against driving arm 84. Although this might not be an absolutely necessary part of the tool, it is further means for assuring that the spline clutch member 52 is re-engaged and the tool is refixed to the straight operation position. In the preferred embodiment, second self aligning spline clutch 62 and mating spline 64 are constructed of a non symemtrical spline face having one wide and one narrow spline member which permits only one direction of engagement or re-engagement of the spline clutch. This re-engagement perserves the azimuthical or rotational angle orientation of the outer casing cylinder 48, the outer casing clutch cylinder 46, and the spline clutch member 52 with its cam driving shaft 34 and cam driving member 84. This ensures that the deflection controlling members of the sub 10 are maintained in a constant angular position with respect to the overall driving string 12, once the string 12 is made up with the directional sub 10, and is essential for preserving the ability to repeatedly control directional drilling downhole without the necessity of tripping out the string or pulling the directional sub for alignment.

Figure 12:
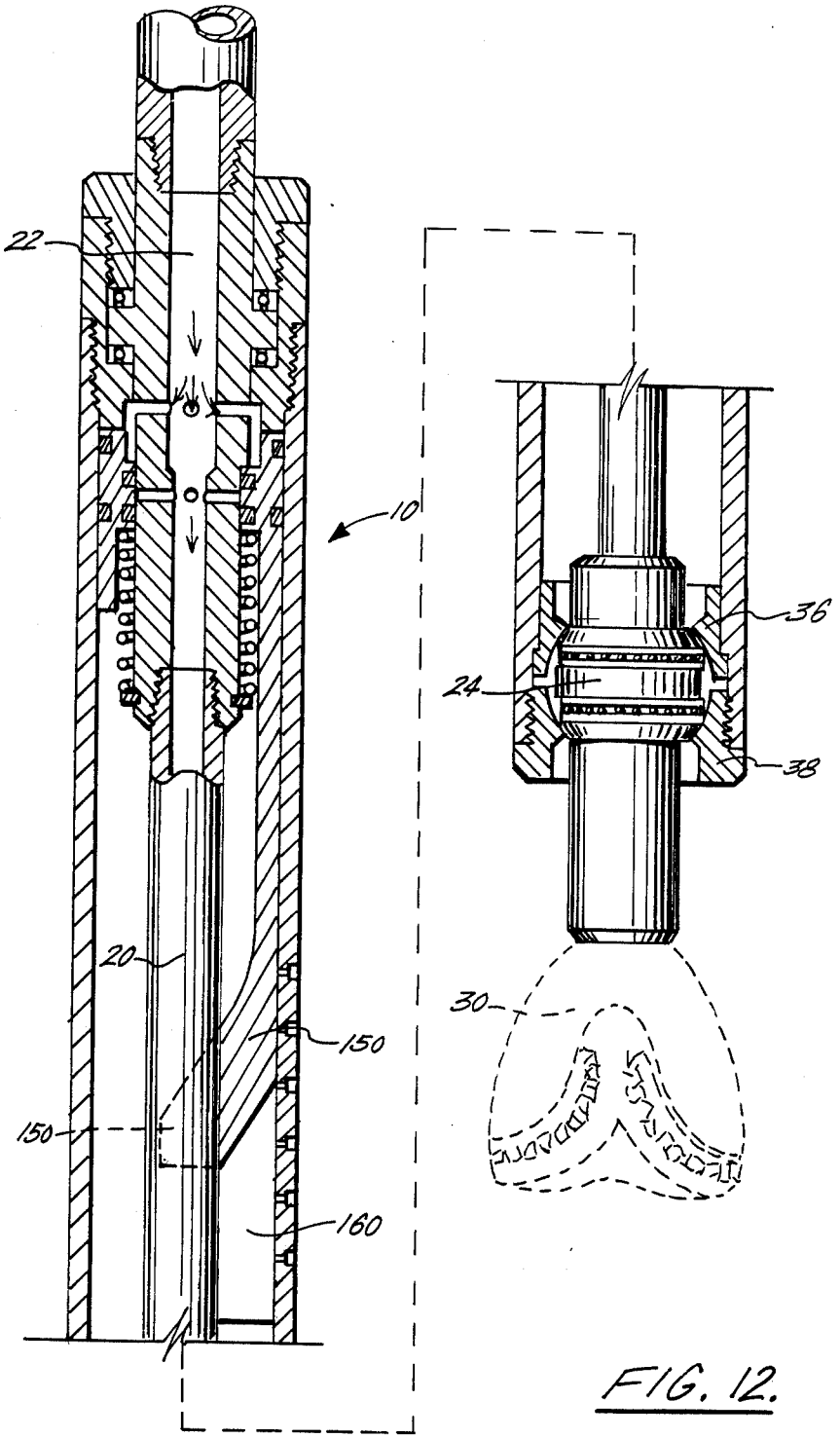
FIGS. 12 and 13 are overall cutaway side views of an alternative embodiment of the apparatus of the present invention.
Figure 13:
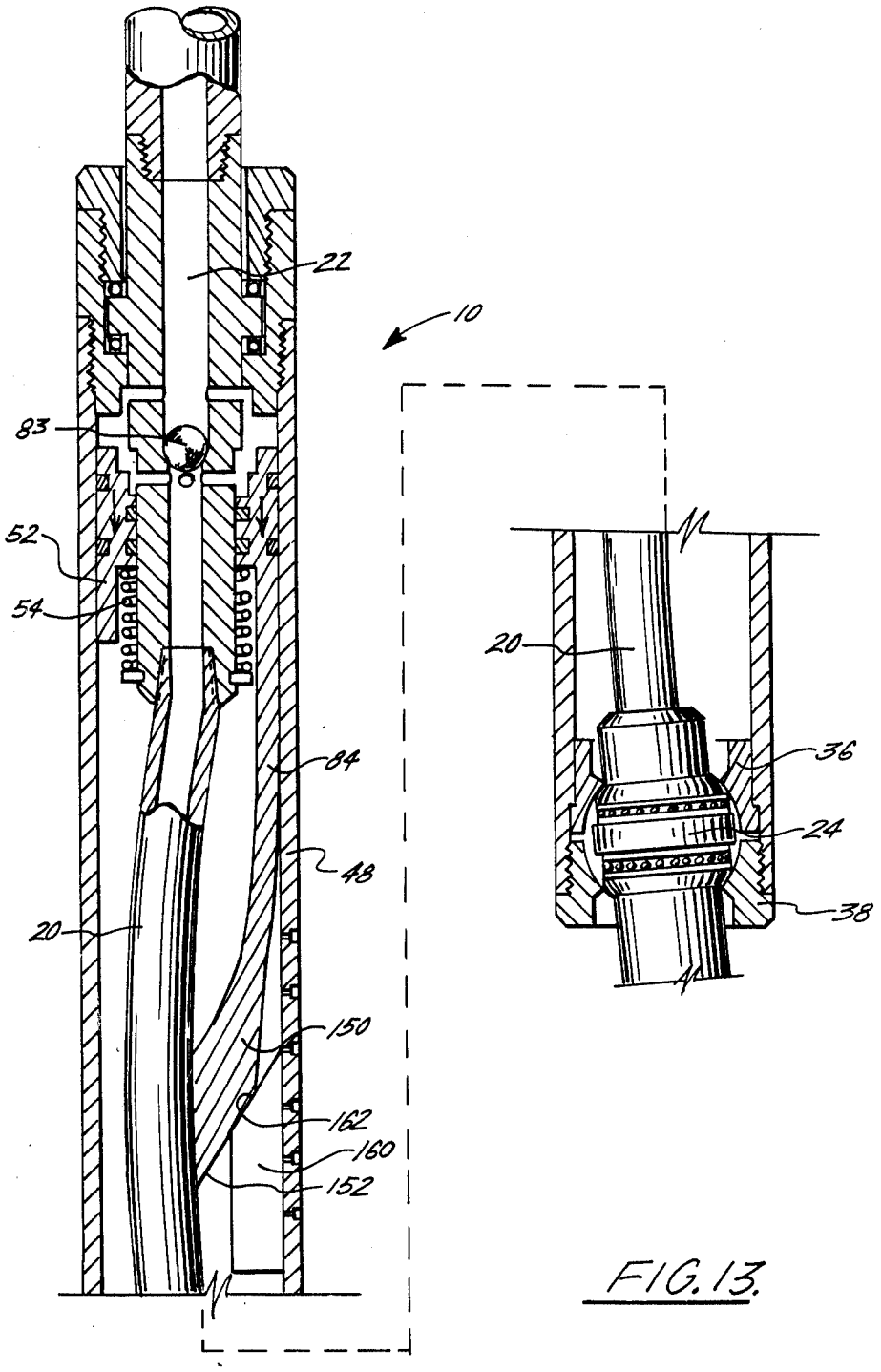

FIGS. 12 and 13 illustrate an additional embodiment of the sub 10 in the invention. The second embodiment illustrates at the lower end of deflection cam driving shaft 84, shaft 84 continuously expanding into a cam yoke member 150. Cam yoke 150 forms a bifurcated sliding free yoke surrounding and rotationally supporting at least one side of the deflection drive tube 20.

As is seen from the FIGURES, there includes no means for maintaining the flexible inner tube member in the align position as with the perferred embodiment, but from end to end, flexible tube member 20 is free to flex under certain conditions.

Cam yoke member 150 has an angled lower face, 152 positioned for sliding deflecting motion against a cam block 160. Cam block 160 is an angled deflecting block having a substantially upward facing angular connecting cam angle upper face 162 and is fixedly attached to outer casing cylinder 48 at a point essentially adjacent a point intermediate the ends of deflection drive tube 20. In operation, at the point at which spline clutch member 52 is moved against the restraining force of spring 54, it is deflected downward, compressing spring 54, disengaging thereby first spline coupling means 58. Clutch 52 in moving to its downward position drives cam driving shaft 84 in a downward position. Cam yoke member 150, coupled by angle lower face 152 against cam block 160 is driven down against cam block 160 and by the intersection of lower face 152 against cam block 160 is deflected away from casing cylinder 48 and towards the center axis of deflection drive tube 20 and the force of yoke 150 deflects drive tube 20 in the middle causing drive tube 20 to enter angularly displaceable lower thrust bearing 24 at an angle differing from vertical. As in the preferred embodiment, this deflection angle approaches two-thirds to one degree of angular deflection.

Also, like the preferred embodiment, upon one wanting to be restored to the straight aligned position, ball 83 would be removed from the tube, mud flow would be opened through inner passage 22 and continue to drill bit 30. At that point spring action of spring 54 returns spline clutch member 52 to an engaged position, and thus cam yoke member 150 slides upward thus restoring tube 20 to its original aligned position.

It can be seen from this description of the preferred embodiment of the invention and the claims which follow that this invention is susceptible to a number of variants within its construction and control means. Therefore, this detailed description should not be viewed as limiting but the invention should encompass all of those equivalent in the embodiments as claimed.

What is claimed as the invention is:

1. A directional drilling tool, for controllable drilling in a deep oil well having a bore, the tool comprising:

a. an elongate, outer, orientable casing member aligned in the bore;

b. an inner, bendable, torque passing member adapted for rotation of a drill bit, journaled within the outer casing member;

c. first collar means for maintaining the bendable torque passing member in a first aligned position in the casing member;

d. second collar means encircling the inner bendable member for shifting the inner bendable torque passing member to a second deflected position, with respect to the outer casing member; and e. means for shifting the first collar means to a position for allowing the inner bendable torque passing member to move to the second deflected position, with respect to the outer casing member.

2. The apparatus in claim 1, wherein the inner bendable member comprises an elongated deflectable tube member adapted for rotation.

3. The apparatus in claim 2, wherein the inner bendable member further includes means for rotation of a drill bit attached to the end of the tube member after orienting the drill bit to an angle established by the tube member.

4. A directional drilling tool, for controllable drilling in a deep oil well having a bore, the tool comprising:

a. an elongate, outer, orientable casing member aligned in the bore;

b. an inner, bendable, torque passing member adapted for rotation of a drill bit, journaled within the outer casing member;

c. first collar means for maintaining the bendable torque passing member in a first aligned position in the casing member;

d. second collar means encircling the inner bendable member for shifting the inner bendable torque passing member to a second deflected position, with respect to the outer casing member; and e. means for moving the first collar means to the position for maintaining the bendable torque passing member in a first aligned position in the casing member.

5. The apparatus of claim 4, wherein the inner bendable member comprises an elongated deflectable tube member adapted for rotation.

6. The apparatus of claim 5, wherein the inner bendable member further includes a means for rotation of a drill bit attached to the end of the tube member after orienting the drill bit to an angle established by the tube member.

* * * * *

UNITED STATES PATENT AND TRADEMARK OFFICE

CERTIFICATE OF CORRECTION

PATENT NO. : 4,732,223

DATED : March 22, 1988

INVENTOR(S) : William N. Schoeffler, et al

It is certified that error appears in the above-identified patent and that said Letters Patent is hereby corrected as shown below:

On the title page, the following names should be added to the list of Inventors in item [75]:

-- William C. Bentley, Lafayette; Joseph L. Stelly, Broussard, La.--

Signed and Sealed this

Fourth Day of October, 1988

*Attest:*

DONALD J. QUIGG

*Attesting Officer*

*Commissioner of Patents and Trademarks*